US005697189A

United States Patent [19]

Miller et al.

[11] Patent Number: 5,697,189

[45] Date of Patent: Dec. 16, 1997

[54] LIGHTWEIGHT INSULATED CONCRETE WALL

[76] Inventors: John F. Miller; Andrew J. Miller, both of 5253 Kalanianaole, Honolulu, Hi. 96821

[21] Appl. No.: 497,626

[22] Filed: Jun. 30, 1995

[51] Int. Cl.[6] ..... E04C 2/288

[52] U.S. Cl. ..... 52/79.9; 52/309.12; 52/309.16; 52/405.2; 52/405.3; 52/601; 52/602; 52/794.1

[58] Field of Search ..... 52/600, 601, 602, 52/405.1, 405.2, 405.3, 309.12, 309.17, 79.9, 79.14, 309.16, 794.1

[56] References Cited

U.S. PATENT DOCUMENTS

| | | | |
|---|---|---|---|
| 2,645,114 | 7/1953 | Amirikian | 52/79.14 X |
| 3,775,240 | 11/1973 | Harvey | 52/309.17 X |
| 3,922,413 | 11/1975 | Reineman | 52/405.1 X |
| 4,047,357 | 9/1977 | Mulholland et al. | 52/602 X |
| 4,454,702 | 6/1984 | Bonilla-Lugo et al. | 52/405.3 X |
| 4,700,518 | 10/1987 | Akihama | 52/309.17 X |
| 4,823,534 | 4/1989 | Hebinck | 52/309.12 X |
| 5,119,606 | 6/1992 | Graham | 52/309.12 X |

*Primary Examiner*—Christopher Kent
*Attorney, Agent, or Firm*—Ladas & Parry

[57] ABSTRACT

A lightweight structural concrete wall panel for house construction, includes a sandwich construction of two thin fiber reinforced concrete faces enclosing vertical panels of insulation material consisting of expanded polystyrene. Vertical structural concrete ribs between the insulation panels are used to interconnect the concrete faces. A continuous track system cast in the upper edge of the panel and projecting connect bars at the lower edge of the wall, connecting this wall to the surrounding structure in such a manner that the floor slab can be poured after erecting the walls. The face of the wall panel can be cast in such a manner as to appear as siding or another desirable building surface. Window and door openings can also be cast into this wall.

11 Claims, 5 Drawing Sheets

LIGHTWEIGHT INSULATED CONCRETE WALL

FIELD OF INVENTION

This invention relates to a method of manufacturing and installing lightweight, concrete-encased house wall panels.

BACKGROUND OF THE INVENTION

The construction of a conventional lumber-framed house has evolved into a slow and expensive process.

The original simple one-trade, one-material house, held together with nails or mortar, is now a complex process. This process now involves approximately twelve different trades, approximately twenty different suppliers, and an even larger number of fixing methods.

The introduction of these many different construction materials and fixing methods, together with the development of the different skills required to assemble these materials, has resulted in a very slow and relatively expensive residential construction process.

The house construction methods have also evolved and divided up into many specialized groups of tradesmen, each with their own materials, tools, and construction techniques.

Consequently this entire house construction process is now slow and expensive. Slow because of the time to assemble a large variety of main components and a large quantity and variety of fasteners, and because of the complexity of supplying these construction components in a specific order, using the appropriate tradesmen.

The expence is further driven up by:

1. The labor cost of organizing this complex construction process.
2. Division of responsibilities between the various trades, in turn creating a lack of continuity of work, thus adding to the labor costs.
3. The cost of handling and temporarily storing these individual components.
4. The cost of clean up and disposal of the building waste materials.

The choice of building materials relates to its durability, and the costs of these selected materials. Durable materials, such as brick and stone, are generally more expensive to purchase, transport and erect primarily because of the additional labor costs involved in manufacturing, handling, and selling these very large quantities of small, heavy construction elements to make the basic walls of a house.

The ability of the conventional exterior wall siding to resist the natural elements is primarily related to the quality of the workmanship and the durability of the materials selected.

The ability of the individually selected siding and trim materials to resist warping depends largely on the ability of the selected material to resist the absorption of moisture and heat with very little expansion or contraction and the frequency of the attaching and interlocking methods.

In order to resist the intrusion of rain and the subsequent damage to the building materials, it is essential that all joints on the outside face of the walls are tight and caulked, and that all exposed edges and faces be protected with a suitable paint.

One type of siding material consists of thin cementious strips in the shape of lumber siding with a wood-grained surface. This durable wood fibre reinforced concrete siding material is fixed in the conventional manner with nails and caulked joints. This durable material does not offer any substantial cost saving.

Frequently contractors use other cheaper less durable siding materials such as 8'×4' sheets of plywood with vertical grooves and with interlocking vertical joints.

The complexity of the construction of a typical external house wall can be revealed by observing the numerous layers of material, starting with siding over a thermal and/or insulating substrate attached to a lumber or light gauge steel frame, and including gypsum wall sheeting over the interior face of the wall.

The external wall cavity between each wall facing is filled with an insulation material. Also in this cavity are brackets securing the wall to the floor and roof, and diagonal braces together with electrical wiring and plumbing elements. A closer inspection will reveal numerous fastening devices and finishing methods at these fasteners.

The siding and trim members are nailed to the frame, with the nail heads frequently set below the surface and the nail head cavities filled and sealed to hide the nail heads. Care must be exercised in selecting the correct siding nail to avoid weathering and rusting of the nail head, which in turn spoils the external surface of the wall.

The substrate is also nailed to the frame and frequently this substrate sheet has a large number of nails so that the shear value of these nails together with the substrate sheeting creates a structural diaphragm to resist the lateral wind forces applied to each wall from an adjacent wall.

Additional fasteners are used to assemble the wall frame, and to anchor the wall frame to the floor, to other walls, and to the structural elements above the wall.

Additional structural anchor brackets are now used in this wall frame to secure the roof and walls in the event of wind and earthquake. Each of these brackets has its own fastening devices.

Staples are generally used to attach the insulation materials.

The gypsum wall board is fastened to the wall frame with nails or screws, with the nail or screw heads set below the surface and covered with a drywall mud to hide these heads. All of the joints between the gypsum wall boards are attached to each other with drywall mud and tape so that this wall surface remains an integral piece and the joint lines are not visible.

Interior walls are similar in construction to external walls, except the external sheathing and substrate is replaced with gypsum wall board and the insulation materials are omitted.

The size and shape of each of these individual components has evolved around the fact that each component should remain as versatile as possible.

To this end an entire set of easily recognized sizes and manufacturing standards have been devised to accommodate this construction industry. For example 2"×4"×94" lumber studs spaced at 16" or 24" centers within an 97" high wall. The actual lumber size, wood species, growth imperfections, straightness, and fastening methods are clearly defined. Other examples are the standard 48"×96" sheet size for siding and plywood.

Other factors adding to costs and complexity of construction include more stringent regulations relating to the ability of the house to resist rain, fire, hurricane, earthquake, termites, heat loss, etc.

Another factor influencing the cost of a conventional lumber-framed wall is the increasing cost and the decreasing quality of lumber.

As a result some contractors are now turning to light-gauge galvanized steel framing materials to replace lumber. Unfortunately, carpenters are not skilled as sheet metal workers, thus they need to be retrained in the techniques of using sheet metal.

Other contractors are using factory-assembled, partially completed walls and partially assembled houses in an effort to reduce on-site labor costs.

There are numerious existing methods of constructing concrete-faced panels with expanded polystyrene insulation. One such panel consists of two layers of structural concrete panels separated by a relatively thin layer of insulation and these two concrete layers laced together with small steel trusses (Insteel). These panels are heavy normal weight concrete separated by the insulation panel, without internal ribs and the appearance of a typical house wall.

Another such panel consists of insulation panels separated by structural steel studs and a relatively thick concrete face on one side of the panel only. The second face is covered with gypsum board after erecting these panels. These panels are relatively heavy and incomplete in the manufacturing process.

Still other systems consist of vertical modular panels usually of a common width, that are interlocked together mechanically. The joints between these panels require mechanical seals and the panel joint line is generally not acceptable in house construction.

Still other systems consist of expanded polystyrene blocks assembled on site with both faces plastered. This process is a relatively slow process and not a complete factory-produced product, with a specific desirable texture.

SUMMARY

A lightweight structural concrete wall panel for house construction, includes a sandwich construction of two thin fibre reinforced concrete faces enclosing vertical panels of insulation material consisting of expanded polystyrene. Vertical structural concrete ribs between the insulation panels are used to interconnect the concrete faces. A continuous track system cast in the upper edge of projecting connect bars at the lower edge of the wall, connecting this wall to the surrounding structure in such a manner that the floor slab can be poured after erecting the walls. The face of the wall panel can be cast in such a manner as to appear as siding or another desirable building surface. Window and door openings can also be cast into this wall.

DESCRIPTION OF DRAWINGS

Figure 1:
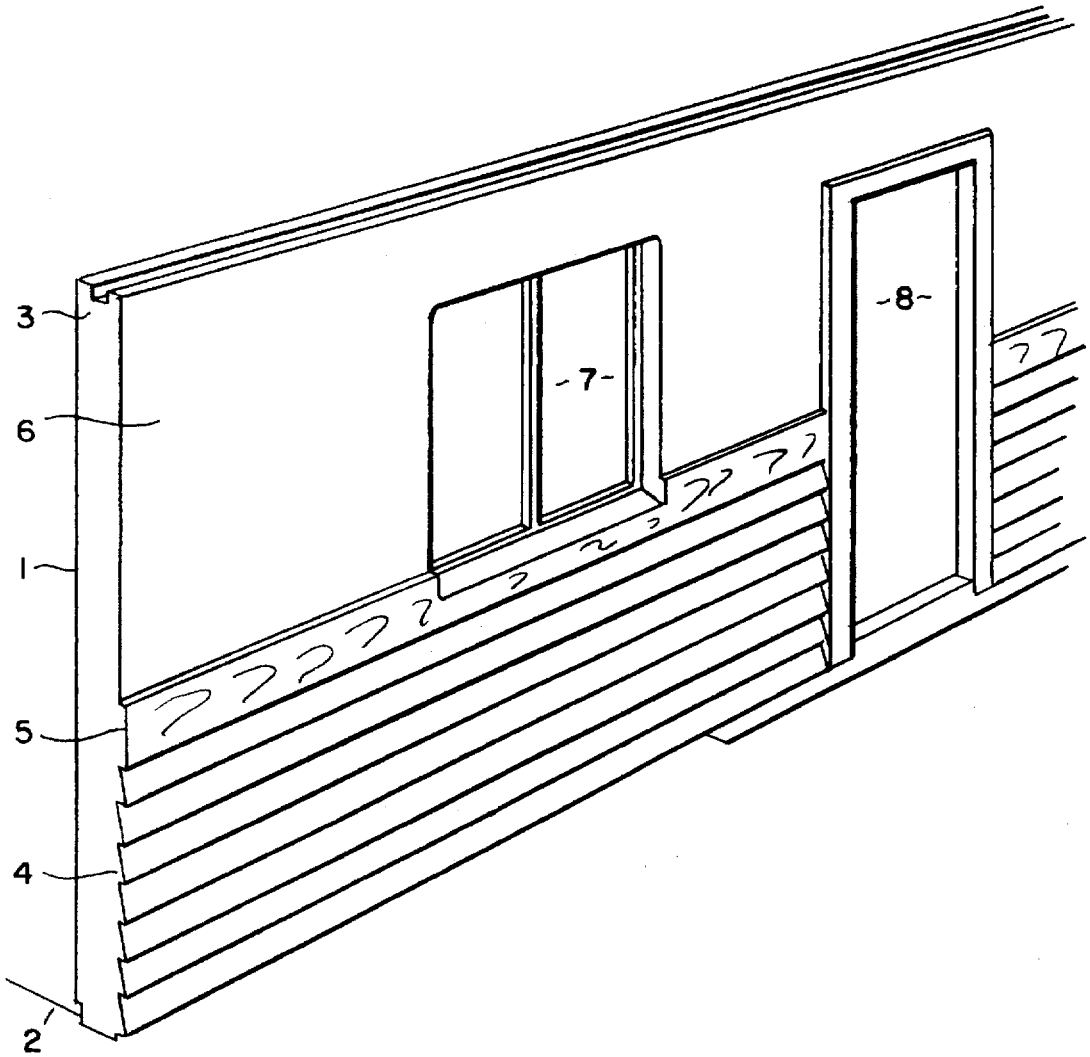
FIG. 1 is an isometric view of a precast concrete house wall showing the external architectural features on the wall such as siding, and windows, and the wall connection to the floor and roof.

FIG. 1 is an isometric sketch of pad of a house wall (1) with a lower connecting device (2) and an upper track (3) with the lower part of the external face of this wall containing a horizontal siding pattern (4) and additional architectural feature of a decorative horizontal wood grained beam (5). The upper external face of the wall (6) is shown without any decorative finish. A window (7) and doorway (8) are also included in this sketch.

Figure 2:
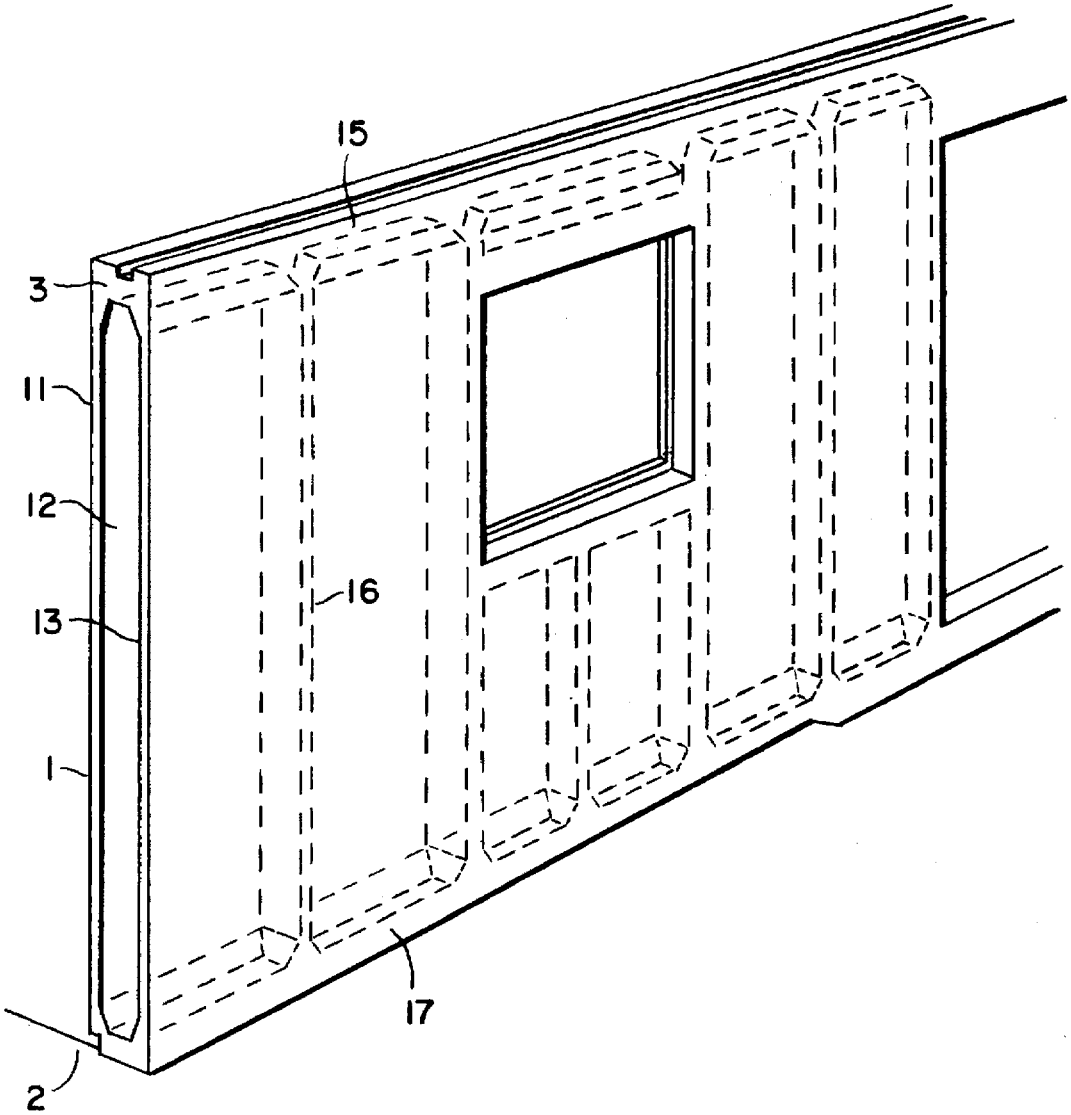
FIG. 2 is an isometric view of a precast concrete wall showing the internal structure of the wall.

FIG. 2 is an isometric sketch of pad of a house wall (1) showing the internal structure of the wall panel (1), the vertical blocks of expanded polystyrene (12) with tapered edges totally encased in concrete, the outside skin (13) shown without any decorative surface, the inside skin (11), the upper beam (15) at the top of the wall containing the continuous track (3), the vertical I shaped concrete structural rib (16) between the expanded polystyrene blocks (12) and the lower horizontal beam (17) containing the floor connecting device (2).

Figure 3:
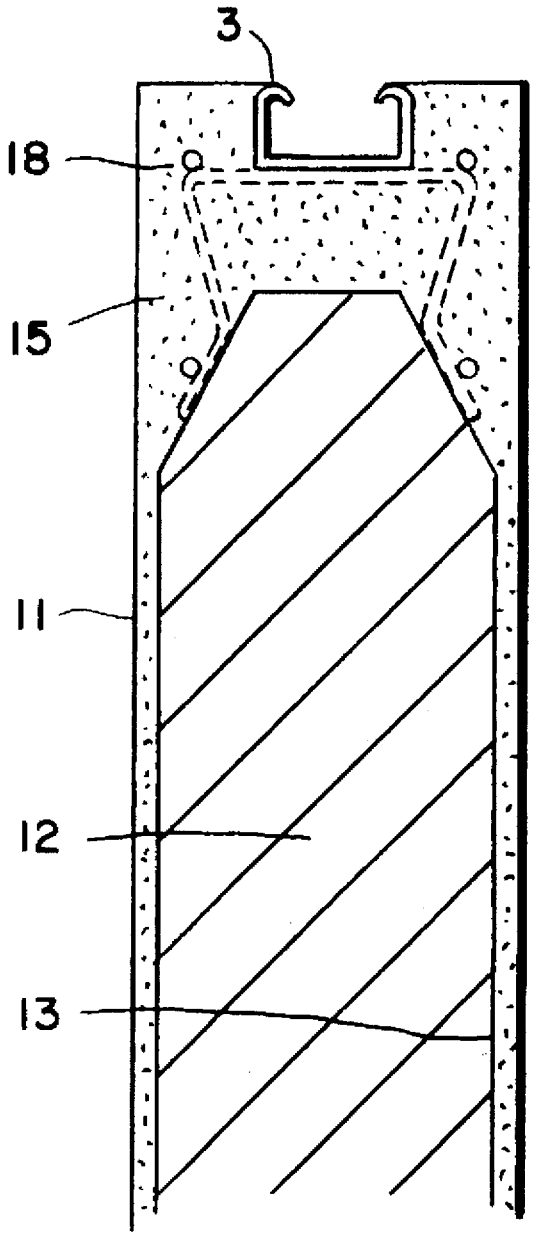
FIG. 3 is an enlarged typical vertical section through the upper portion of the wall.

FIG. 3 is a vertical section through the upper beam (15) of the wall panel (1) showing the continuous upper track (3), the outer skin (13) the expanded polystyrene, the insulation block (12), the inner skin (11 ), and the reinforcing steel (18) attached to the upper track (3).

Figure 4:
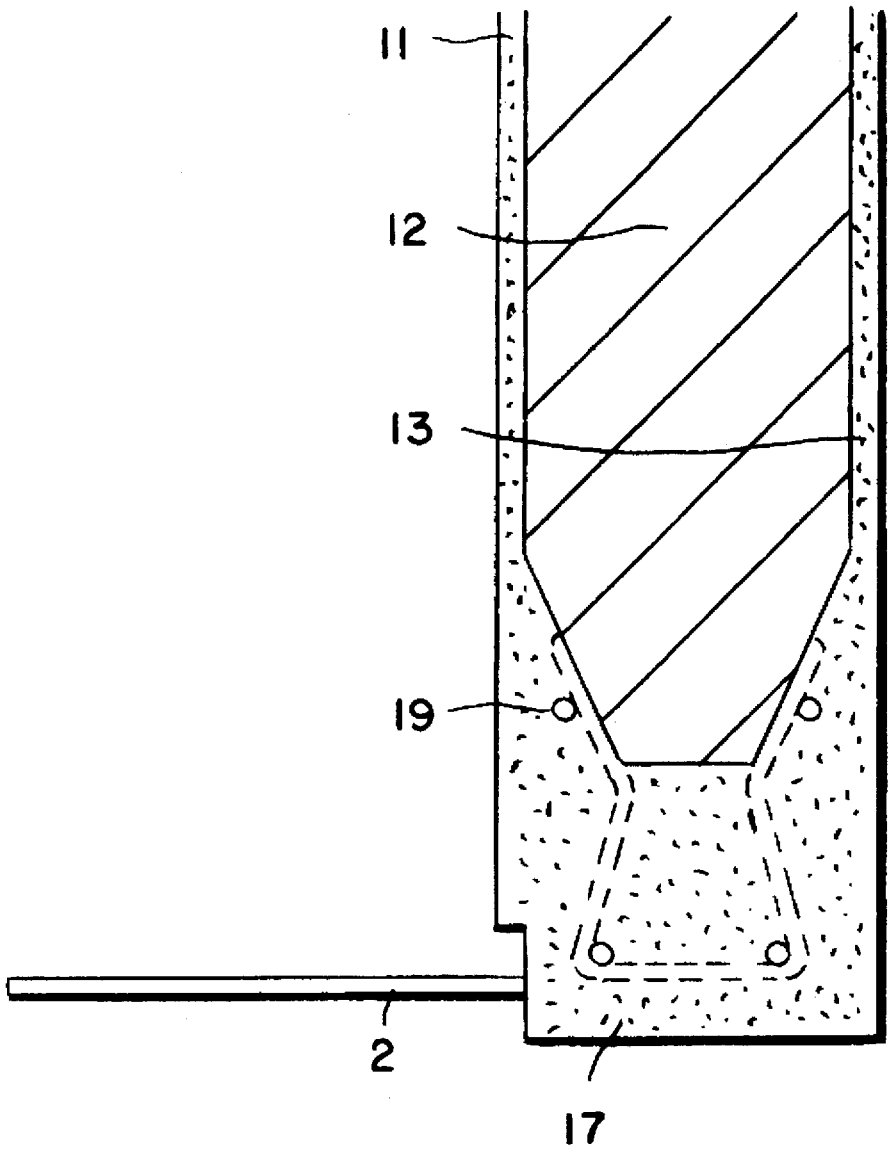
FIG. 4 is an enlarged typical vertical section through the lower portion of the wall.

FIG. 4 is a vertical section through the lower beam (17) showing the projecting floor connecting device (2), the outer skin (13) and the expanded polystyrene internal insulating block (12). Reinforcing steel (19) is shown within this lower beam (17).

Figure 5:
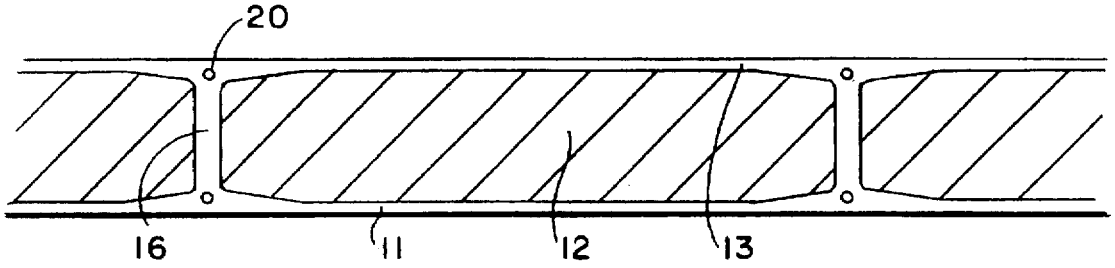
FIG. 5 is a typical horizontal section through the wall, showing the construction of the wall.

FIG. 5 is a typical horizontal section through part of a wall, showing the vertical ribs (16) with reinforcing steel (20) cast between the blocks of expanded polystyrene insulation (12) with tapered edges, and the external concrete skin (13) and the internal concrete skin (11).

DETAILED DESCRIPTION OF INVENTION

The preferred embodiment of the invention is illustrated in the attached drawings which are referred to herein. The same reference numeral will be used to identify identical elements throughout the drawings.

FIG. 1 illustrates the exterior appearance a precast concrete wall 1 illustrating some of the various types of surface textures that can be cast into the face of these walls. Illustrated is horizontal siding 4, a belly-band with wood grained surface 5, and a smooth face 6 interrupted by a window 7 and door 8. The connection means to the roof or floor above is a continuous track 3 cast into the upper edge of the wall. At the lower edge of the wall is another connection device 2 comprising numerous projecting steel reinforcing bars that subsequently connect this precast wall to the floor.

FIG. 2 illustrates the internal construction of this precast concrete wall 1, showing the blocks of insulation 12 consisting of expanded polystyrene manufactured and positioned in such a manner as to create a void to form the structural concrete elements within the panel, such as the vertical ribs 16, the upper beam 15, the lower beam 17. The inner and outer faces of this insulating material 12 are also covered with thin structural concrete surfaces that create structural diaphragms on either side of the wall panel. The outer face 13 and inner face 11 of the wall can be cast in such a manner as to include any desirable surface shape or texture such as siding or other architectural features. Additional openings can be cast into this concrete wall to create window and door openings.

Additional provisions can be made to interconnect these walls with adjacent walls. These wall panels are cast in such a manner that the concrete is poured monolithically and totally envelopes the insulating material.

FIGS. 3, 4 and 5 show specific structural elements within the wall panels.

The upper track 3 are attached to steel reinforcing bars 18 that is cast into the concrete upper beam 15, to stiffen the upper edge of the wall and connect this wall to the structure above.

The lower edge of the wall is similarly constructed with steel reinforcing bars 19 and projecting connector bars 2 are cast into the lower beam 17 so that this wall can be erected and subsequently anchored to the floor.

FIG. 5 illustrates typical vertical ribs 16 within the wall showing the specific shape of the monolithically cast concrete surrounding the insulation material 12. Included within these vertical ribs 16 is steel reinforcing 20 and progressively thickened surfaces on either side of the wall panel that contribute to the strength of the vertical rib and the faces of the wall.

With the present invention a builder may to manufacture a complete structural wall using cementious faces wall of the desirable elements of a wall such as strength, durability, insulation, various surfaces textures, impervious to termites and decay, and resists natural elements such as rain, wind, fire, earthquake and flood.

With the present invention the builder may manufacture these one piece walls in a cost-controlled factory environment where all the walls of a house can be premade and shipped to the house site, complete with windows.

With the present invention the builder may eliminate many of the on site tradesmen involved in assembling a conventional framed house, namely, rough framing carpenters, insulation installers, siding installers, rough-in electricians, rough-in plumbers and finish carpenters, including their tools and equipment.

With the present invention the builder may reduce many components that make up a wall.

With the present invention the builder may eliminate all of the fastening components such as nails, screws, brackets and hold down bolts with the use of one complete concrete wall component with built in fastening systems.

With the present invention the builder may eliminate all of the joints between the wall components that normally must be accurately fitted together on site, caulked or taped, and edge painted to either exclude weather or cover the unsightly joint between members.

With the present invention the builder may be able to include windows and/or doors in these preassembled walls, including the trim members surroundings these elements.

With the present invention the builder may have these wall assemblies with internal insulation to meet national energy codes.

With the present invention the builder may have these concrete walls light enough to handle with readily available cranes. Conventional concrete wall weight approximately four times (4) as much as these lightweight wall panels. In addition, these walls for one entire single family house can be transported on one truck, whereas solid concrete walls for the same house would need 3 to 4 trucks to carry the same walls.

With the present invention the builder may be able to reproduce any desirable surface texture on the face of the wall panel, such as wood grained siding, smooth plaster, horizontal or vertical grooves or projections, brick and block patterns and stone etc. in the monolithic surface of the wall panel.

With the present invention the builder may simplify and speed up the house construction process by premanufacturing these walls off site and rapidly site assembling these completed walls with the use of a crane.

With the present invention the builder may be able to temporarily store, handle and erect these wall panels in inclement weather, without damage to the wall panel surfaces. Conventional internal walls are faced with paper-faced gypsum boards and joined with a water soluble jointing compound. This type of wall facing material can only be safely installed after the house is made weatherproof, otherwise, rain will ruin these gypsum board walls. The concrete faced panels of this invention are impervious to rain damage.

With the present invention the builder may have a wall panel that can be easily connected to the adjacent wall panels, to the floor below, and to the ceiling above these wall panels in such a manner as to exclude moisture and drafts.

With the present invention the builder may shape the voids between the preshaped blocks of insulation so the concrete surrounding this insulation is formed in suitable structural I beams and U beam shapes that provide sufficient structural strength to the panel with the minimum amount of concrete.

With the present invention the builder may provide steel reinforcing to the panel to provide sufficient strength to the structural shapes within the panel.

With the present invention a builder may manufacture a wall panel that is not subject to termite damage. The concrete panel surface is unbroken, thus excluding all termites, insects, vermin etc.

With the present invention a builder may have a durable, hard resistant surface on both faces of the wall panel, unlike drywall with a paper finish or wall siding consisting of unfinished wood or compressed wood fibres.

With the present invention a builder may have a fire resistant panel, able to resist internal or external fires.

CONCLUSIONS, RAMIFICATIONS AND SCOPE OF INVENTION

Thus the reader will see that a monolithically poured concrete wall with two very thin cementious skins with additional reinforced concrete ribs and beams surrounding thick panels of insulation material is disclosed. This manufactured wall contains additional attaching means and a desirable surface texture. While the above descriptions contains many specific, these should not be construed as limitations on the scope of the invention, but rather as one preferred embodiment thereof.

We claim the following:

1. A wall panel having a height and a width and top and bottom edges, said wall panel comprising at least one block of insulative material surrounded by a monolithically poured cementious material, each of said at least one block of insulative material extending through substantially the entire height of said wall panel but for relatively narrow portions of said wall panel located along each of the top and bottom edges of said wall panel, wherein said top edge of said panel has a continuous track formed therein adapted to facilitate the joining of said panel with adjacent structure, and wherein said panel further comprises floor connection means adapted to project into a subsequently cast floor.

2. The wall panel of claim 1 wherein said track is cast in said cementious material.

3. The wall panel of claim 1 wherein said at least one block of insulative material is a plurality of blocks of insulative material, each of which extends through substantially the entire height of said wall panel but for said relatively narrow portions of said wall panel located along the top and bottom edges of said wall panel and each of which is surrounded by said monolithically poured cementious material.

4. The wall panel of claim 3 wherein said blocks of insulative material are disposed in spaced apart relationship to each other and each of which is surrounded by said monolithically poured cementious material.

5. The wall panel of claim 4 wherein each of said blocks of insulative material has ends having tapered corners.

6. The wall panel of claim 5 wherein said blocks of insulative material are aligned so that at least one cementious structural rib extends substantially from near said bottom edge of said panel to near an oppositely disclosed said top edge of said panel.

7. The wall panel of claim 5 in which said cementious material is reinforced with fibrous material.

8. The wall panel of claim 5 in which said insulative material is expanded polystyrene panels.

9. The wall panel of claim 5 in which said floor connection means are steel bars that are partially cast in said wall panel and are adapted to project into the subsequently cast floor.

10. The wall panel of claim 5 in which steel reinforcing bars are used to reinforce at least one edge of said panel.

11. The wall panel of claim 5 in which a surface texture of one or more faces of said panel is cast in such a manner as to give an appearance of another construction material such as siding, or bricks.

* * * * *